US007896978B2

(12) United States Patent
Lofton et al.

(10) Patent No.: US 7,896,978 B2
(45) Date of Patent: Mar. 1, 2011

(54) THERMAL FLUID STIMULATION UNIT

(76) Inventors: Dana Wayne Lofton, Houma, LA (US); Thurman Eddie Lofton, Jr., Theriot, LA (US)

( * ) Notice: Subject to any disclaimer, the term of this patent is extended or adjusted under 35 U.S.C. 154(b) by 0 days.

(21) Appl. No.: 12/660,706

(22) Filed: Mar. 4, 2010

(65) Prior Publication Data

US 2010/0163080 A1 Jul. 1, 2010

Related U.S. Application Data

(60) Division of application No. 11/726,421, filed on Mar. 22, 2007, now Pat. No. 7,740,708, which is a continuation-in-part of application No. 11/452,491, filed on Jun. 14, 2006.

(51) Int. Cl.
*B08B 9/00* (2006.01)

(52) U.S. Cl. ..... 134/166 R; 134/166 C; 134/198

(58) Field of Classification Search ..... 134/166, 134/166 R, 198
See application file for complete search history.

(56) References Cited

U.S. PATENT DOCUMENTS 5,350,018 A 9/1994 Sorem et al.
5,400,430 A 3/1995 Nenniger
5,822,992 A 10/1998 Dean
6,116,340 A 9/2000 Wilson et al.
6,550,487 B1 4/2003 Duckett et al.
2008/0067129 A1 3/2008 Juenke et al.
2008/0164021 A1 7/2008 Dykstra
2009/0065197 A1 3/2009 Eslinger
2009/0294122 A1 12/2009 Hansen et al.

*Primary Examiner*—Michael Barr
*Assistant Examiner*—Jason Heckert
(74) *Attorney, Agent, or Firm*—Keaty Law Firm LLC

(57) ABSTRACT

A reservoir cleaning, treating and/or stimulation system allows the operator to control the speed and pressure of delivery of the treating fluid into the reservoir and remove or dissolve sediment particles settled in the reservoir or the reservoir formation. The system uses a thermal heater capable of heating the treating fluid from ambient temperature to about 400 degrees Fahrenheit. A charge pump mounted on an intake side of the heater forces the treating fluid through the heater, while the treating fluid passes through the tubing of the heater. The heated treating fluid is channeled to a discharge pump on an outlet side of the heater, where the treating fluid is pressurized to a value sufficient to overcome the pressure existing within the reservoir and cause displacement or dissolution of the sediment in the reservoir. A flow meter mounted between the heater and the charge pump regulates the volume of the treating fluid being admitted into the heater. A plurality of sensors and gauges strategically mounted within the system ensure safe operation of the system in the field. The system is mounted on a portable skid that can be delivered to the field and removed upon completion of the cleaning, treating and/or reservoir stimulation operation.

12 Claims, 3 Drawing Sheets

THERMAL FLUID STIMULATION UNIT

CROSS-REFERENCE TO RELATED APPLICATIONS

This application is a divisional application of my patent application Ser. No. 11/726,421 filed on Mar. 22, 2007 now U.S. Pat. No. 7,740,708 entitled "Thermal Fluid Stimulation Unit," which is a continuation-in-part of my co-pending application Ser. No. 11/452,491 filed on Jun. 14, 2006, entitled "An apparatus and Method for Cleaning and Stimulating Reservoirs," the full disclosures of which are incorporated by reference herein, and priority of which is hereby claimed.

BACKGROUND OF THE INVENTION

1. Field of the Invention

The invention relates generally to an apparatus and method for stimulating reservoirs, such as vessels, barges, mud tanks, storage tanks, holds, other storage units, and flow lines using heated liquid injections. More particularly, the invention relates to an apparatus for stimulating reservoirs, vessels, tanks, holds, other storage units, or flow lines by injecting therein heated fluids under pressure and a method of stimulating reservoirs using such apparatus. As used in this application, a reservoir can be a tank used for collecting and storing a liquid, a receptacle or chamber for storing a fluid, a receptacle or chamber for holding a liquid or fluid, a subterranean accumulation of oil or gas held in porous and permeable sedimentary rock (reservoir), a wellbore, a pipeline, or an underground accumulation of petroleum or natural gas.

In the exploration and development of hydrocarbon reservoirs, a well is drilled to a subterranean reservoir, and thereafter, a long string of tubing segments is placed within the well to allow the production of hydrocarbon fluids and gas. During the production phase, paraffin, asphaltines, and other sediment from the surrounding formation settle on the inner surfaces of the production tubing and restrict the fluid flow to the surface. Further, the perforations formed in the wellbore reservoir may become gradually plugged and/or damaged by drilling fluids, sediment, and the like. Once the reservoir becomes damaged, the operator needs to stimulate the reservoir, which is often done with the injection of chemical compounds into the tubing extending in the wellbore. Sometimes, the liquid injection compounds are heated before introduction into the wellbore to facilitate removal of the clogging material from the tubing. Sometimes, the reservoir is stimulated using diesel, other times—using an acidizing material, such as formic acids and other stimulation fluids such as water and hot oil.

In the past, in order to heat these types of compounds, operators could employ an open flame. However, recent governmental government regulations prevent the use of an open-flame heater in an oil- and gas-production environment. Thus, there exists a need for a thermal fluid unit that is capable of heating a reservoir stimulation compound without the need for having an open flame.

2. Description of Related Art, Including Information Disclosed Under 37 CFR 1.97 and 37 CFR 1.98

Apparatus and methods exist to clean or treat reservoirs. In the broadest sense, a reservoir is a vessel, tank, hold, other storage unit, or a pipeline or other flow line. Apparatus and methods for cleaning reservoirs in this broad sense can include apparatus and methods that inject, under pressure, a cleaning, dispersing, treating, neutralizing, or stimulating agent into the reservoir. Methods for cleaning or treating reservoirs include applying heated fluid or chemicals under pressure to loosen, disperse, or dissolve "contaminants." The particular working materials (that is. the composition of the fluid), the temperature of the working materials, and the pressure at which the working materials are introduced into a reservoir depend on the characteristics of the contaminant, which can vary from reservoir to reservoir.

Particular working materials can include, among others hot water, either fresh or salt, gun barrel water (also mown as produced water) heated diesel fuel, heated produced oil, raw chemicals (such as xylene or benzene, either with or without water or diesel oil or heated oil), or heated chemicals. Selecting particular working materials depends significantly on the particular characteristics of the "contaminant" and on the particular application. Applications can include, among others, down hole oil wells or gas wells, vessel storage tanks, vessel holds, pipelines, pig traps, storage tanks, holding tanks, and towers (such as cat crackers, fractionation towers, and emulsifiers). Selection of appropriate temperature and pressure also depends on the application.

European patent No. 032813 describes a process for the removal of sludges from crude or refined oil storage tanks by injecting a dispersing agent into the sludge by means of a water jet. The emulsified oil fractions are removed under pressure and recirculated to the jet. The sludge is physically and chemically altered so that it can be pumped and easily removed from the tank, the emulsion being further mixed to an oil volume sufficient to cause the sludge separation, the water layer being separated and the heavy hydrocarbons recovered.

Japanese publication No. 558030398 describes the treatment of sludges by adding an -amount of solvent and heating by circulating in the oil furnace to extract paraffin waxes and separating solid constituents from the oil fraction.

The so-called T.H.O.R. process is a mechanical system for the recovery of hydrocarbons from the oil sludge and contaminated oil tank bottoms. The process involves penetrating the sludge bulk with a hot water circulating system using a submersible pump. The T.H.O.R. process comprises two stages: sludge moving and sludge refining. To render the sludge mobile, water heated with refinery steam is pumped into the tank to lower the viscosity of the sludge so as to optimize its pumping and recovery. The mobile sludge is pumped through a submersible pumping unit placed in the medium to be pumped. The amount of water placed into the tank is equivalent to that of the sludge to be moved. The water is kept circulating during the whole liquefaction period of the tank contents, which normally takes 1 to 8 days. The pumping process has a maximum flow rate of 15,000 liters per hour, the mass being pumped corresponding to a ratio of 50% water/50% sludge. The mixture is pumped through Alfa Laval equipment for the removal of insoluble foreign matter and water so as to produce oil to be reintroduced in the refining process. The recovered product, of BSW lower than 1% and low conductivity, is mixed to crude oil in predetermined amounts. The so-called "SUPERMACS" system developed by Riedel Environmental Technologies Inc. employs heated water jets under high average pressure in order to melt and heat paraffin and sludge deposits. The products are separated and recovered based on their different, densities, the oil contained in the sludge also being recovered.

U.S. Pat. No. 5,580,391 discloses a process for the thermo-chemical—cleaning of a sludge-containing storage tank for petroleum oil or a similar material which comprises: adding to the sludge in the tank an organic solvent or mixture of solvents which fluidizes the sludge, the volume ratio of solvent: sludge being in the range of 0.5:1 to 2.5:1; adding to the mixture of sludge and organic solvent an aqueous nitrogen-generating system comprising a reducing nitrogen salt, an oxidizing nitrogen salt and an acid activator which interact to generate nitrogen and heat, thereby causing thorough mixing of the sludge, the solvent, and the aqueous nitrogen-generating system; allowing the contents of the tank to separate to form an oil phase consisting essentially of the solvent and the organic constituents of the sludge, a saline aqueous phase comprising the residue of the nitrogen generating system, and, if present, the solid inorganic constituents of the sludge; removing the oil phase and recovering the solvent and other valuable constituents therefrom; removing the aqueous phase and sending it to effluent treatment; and if required removing also any solid inorganic residue remaining in the tank. In this process sludges of crude or refined oil, stored in tanks or any other kind of container, are fluidized and the oil contained therein is recovered by the addition of a solvent having the correct properties to fluidize the sludge, followed by the addition of aqueous solutions of inorganic salts that generate nitrogen and heat.

Considering that an offshore platform presents special challenges to accommodating large systems for stimulating wells and clearing the down-hole perforations, there exists a need for a compact apparatus that can supply pressurized heated liquid to break down paraffin and open up the production lines. The present invention contemplates provision of such a system and a method of providing a heated compound for stimulating a reservoir using a self-contained unit that has a relatively small footprint.

SUMMARY OF THE INVENTION

It is, therefore, an object of the present invention to provide an apparatus and method of stimulating and cleaning a reservoir using a relatively small unit.

It is another object of the present invention to provide an apparatus and method that allows heating of the reservoir stimulating compound, while regulating the pressure and flow rate of the compound delivery into the wellbore tubing.

These and other objects of the present invention are achieved through a provision of a reservoir stimulation system that is designed to allow the operator to control the speed and pressure of delivery of the reservoir treating, cleaning and/or stimulation liquid. The system comprises a thermal heater device capable of heating the treating fluid from ambient temperature to about 400 degrees Fahrenheit. A charge pump mounted on an intake side of the heater device forces the treating fluid through the heater device, while the treating fluid passes through the tubing of the heater device. The heated fluid is channeled to a discharge pump on an outlet side of the heater device, where the treating fluid is pressurized to a value sufficient to overcome the pressure existing within the reservoir and cause displacement or dissolution of the sediment in the reservoir.

A flow meter mounted between the heater device and the charge pump regulates the volume of the treating fluid being admitted into the heater device. A plurality of sensors and gauges strategically mounted within the system ensure safe operation of the system in the field. The system is mounted on a portable skid that can be delivered to the field and removed upon completion of the cleaning, treating and/or reservoir stimulation operation.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
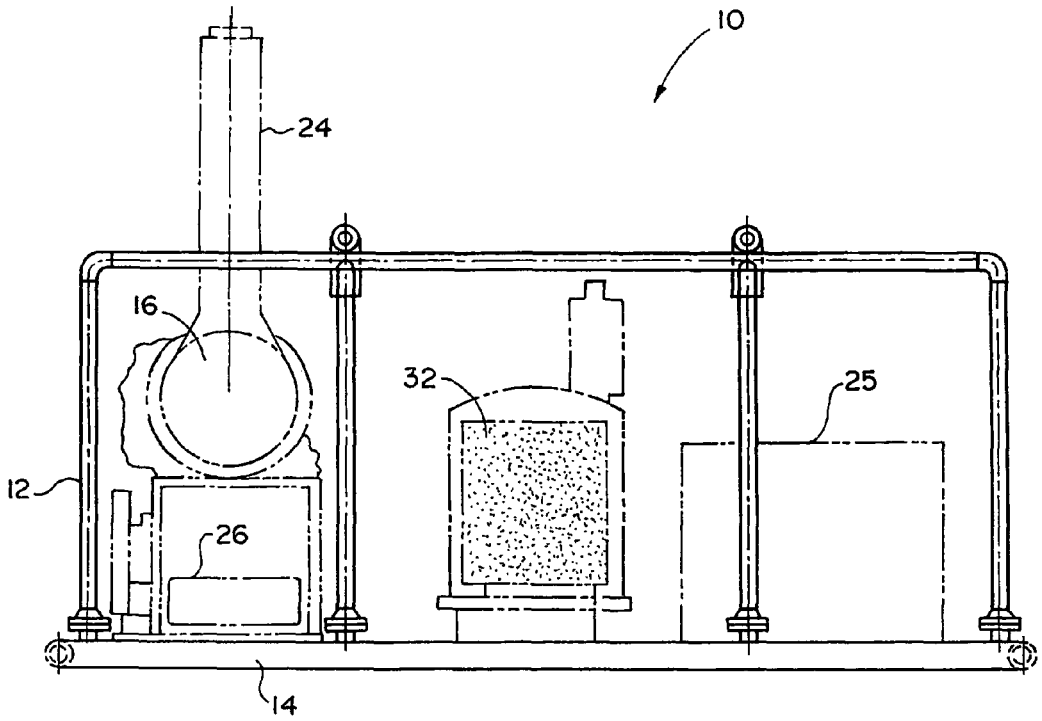
FIG. 1 is a rear elevation view of an embodiment of the cleaning, treating, and/or stimulating system according to the present invention.
Figure 2:
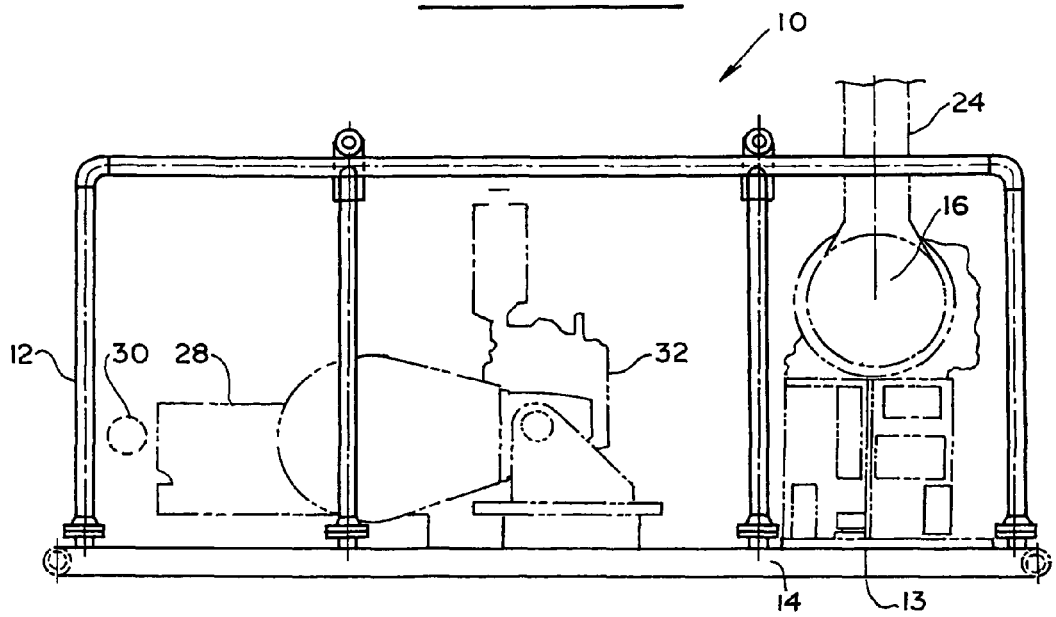
FIG. 2 is a front elevation view of an embodiment of the cleaning, treating, and/or stimulating system according to the present invention.
Figure 3:
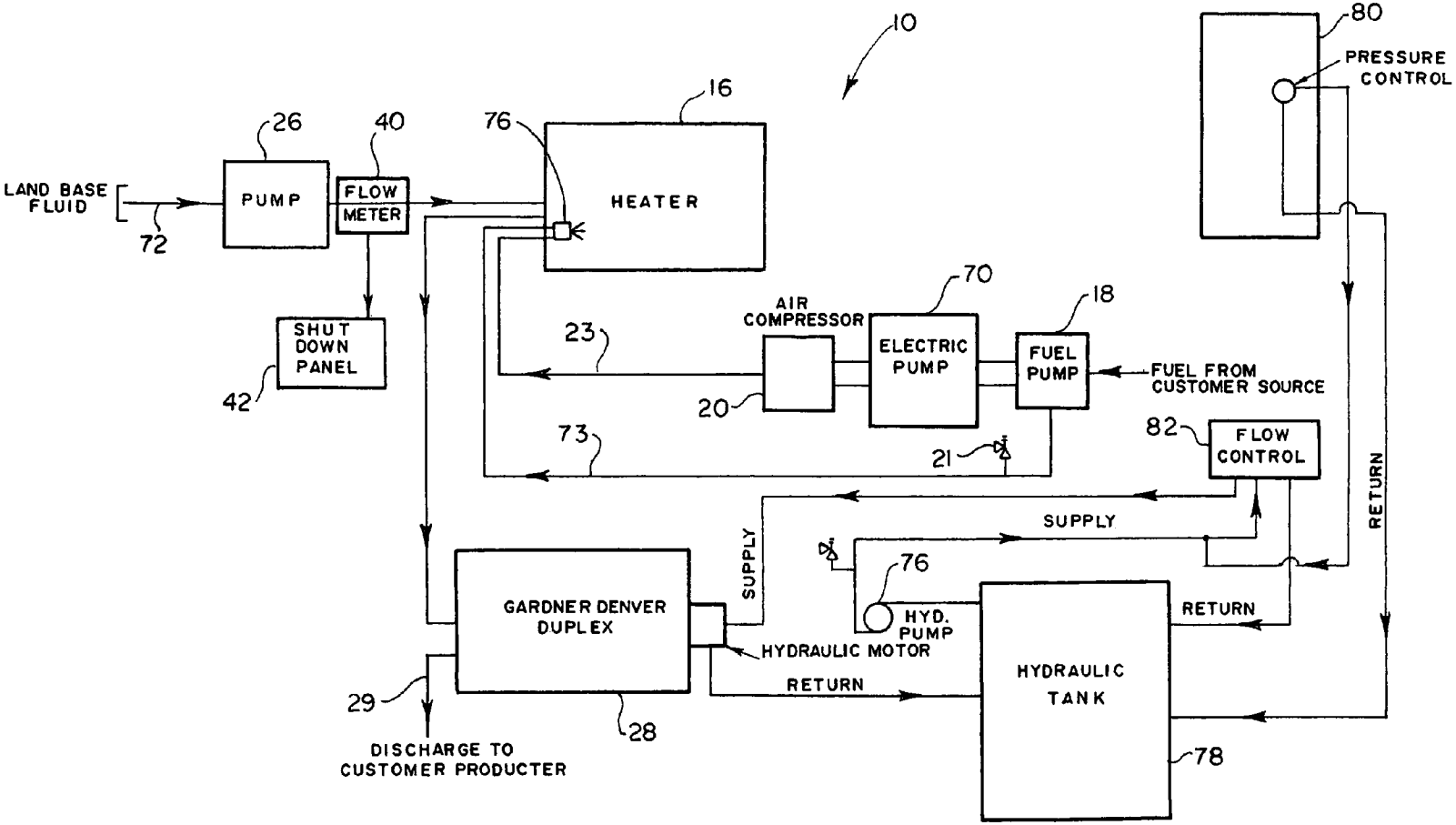
FIG. 3 is a schematic of the piping lines of the cleaning, treating, and/or stimulating system according to the present invention.

Turning now to the drawings in more detail, the apparatus of the present invention is generally designated by numeral 10. The portable stimulation unit 10 comprises a frame 12 positioned on a support base 14 that has a relatively small footprint suitable for use in both onshore and offshore environment. Mounted on the base 14 is a thermal fluid heater, or heater device 16, preferably a single-pass heater, capable of generating between approximately 750 Btu and approximately 12 MM Btu of energy to heat sufficiently a working fluid at the desired pressure and volume flow rate, depending on a particular desired application. Although not shown, it will be understood that the heater 16 has an array of plates and coils that transfer heat to the working fluid. The thermal fluid heater 16 is capable of producing from about 3.5 MM Btu to about 7 MM Btu of heat to clean economically an approximately 2,200 barrel tank at a temperature between ambient and about 350 to 400 degrees F. at a volume flow rate of up to about 200 gallons per minute (about 4½ barrels per minute) and a pressure typically between approximately 25 psi and approximately 200 psi.

A preferred thermal fluid heater for a high pressure, low volume application, such as injection of the heated compound into the production tubing, is capable of producing 3.5 MM Btu of heat to inject heated fluids into reservoirs under pressure, including production systems such as wells, other geological formations, flow lines, transfer lines, and production or refinery equipment, High pressure, low volume applications comprise temperatures between ambient and about 350 to 400 degrees F. at a volume flow rate of up to approximately 84 gallons per minute (about 2 barrels per minute) and pressure typically between approximately 50 psi and 10,000 psi. The working fluid can be selectively discharged from the system at between approximately 25 psi and approximately 10,000 psi at a flow rate between approximately 3 gallons per minute and approximately 84 gallons per minute.

The treating fluid is supplied to the heater 16 through associated inflow conduit 17 with the assistance of a heater inflow pump, or charging pump 26 mounted upstream from the heater 16. A means 40 for regulating an amount of the treating fluid admitted into the heater device 16 is mounted between the charging pump 26 and the heater device 16 to regulate the amount of the treating compound to be heated by the heater 16. The flow meter 40 gives a precise measurement of the amount of fluids passing through the heater 16.

A control panel 42 regulates the operation of the heater 16, the heater charging pump 26 and the flow meter 40. The control panel 42 has visual control devices, such as pressure gauges 46, 48, 50, 52, 54, & 56 with internal switches for safety and control, that allow an operator to regulate pressure and flow rate of the reservoir treating fluid. In case of an emergency, the operator can shut down the operation of the unit 10 by manipulating the switch 61-ESD on panel 60. The control panel 42 is operationally connected to an operating panel 60 that is provided with a "Start" push button 62, a "Run" push button, and a "Stop" push button 64.

The pressure gauge 46 with internal switch 94 registers the high & low fuel pressure and is operationally connected to a fuel pump 18 that supplies heating fuel to the heater 16 via an electric pump 70, which forces fuel through a heater nozzle 71 and works in sync with air compressor 20 to atomize the fuel to provide a clean mixture of air and fuel. The fuel pump is capable of flowing up to approximately 90 gallons per hour at approximately 130 psi. A regulator 21 is installed in the pipeline 73 extending from the fuel pump 18 to the heater 16. The pressure gauge 48 is connected to the high/low air pressure sensor 49 to allow the operator to observe the operating condition of the air compressor 20. The pressure gauge 50 is connected to the low blower pressure sensor 51 to allow the operator to visually observe changes in air pressure supplied by the blower 20.

The switch and gauge 52 allows the operator to send a "process heat" signal to the heater 16; the switch 54 sends a "stack temperature" signal, while the switch 56 connects the regulator of high-low pressure in the heater 16.

The system according to the invention also includes a blower 22 that is designed to blow ambient air via suitable piping 23 into the heater 16. The air ultimately discharges out of an exhaust stack 24, as well as air compressor 20, which is used to atomize the fuel that is supplied from a fuel tank 25 preferably mounted on the base, or skid 14, on which the elements of the system 10 are positioned. Alternatively, fuel can be supplied through suitable hoses from a customer source in situ. Any air compressor that provides 3.9 to 4.5 cfm could be used as the air compressor 20 in the system of the present invention.

Superheated air is blown across the coils of the heater 16 that contains the pumped working fluid to heat the fluid to a sufficient temperature. The heated fluid is then discharged under sufficient pressure and at sufficient volume to accomplish a desired application. Alternatively, the heater 16 could be valved off for ambient temperature applications. The pressure gauge 50 is operationally connected to the blower 22 to help regulate the blower operation.

The charging pump 26 mounted on the intake side of the heater 16, charges (i.e., forces fluid through) the heater. If desired the system of the present invention may also include a discharge pump that could terminate in a discharge port or a nozzle, depending on the application. Depending on the application, the heater charging pump 26 could be used alone and the discharge pump could he valved off. For a low pressure, high volume application, the pumps can be space-saving centrifugal pumps having a 13" casing and an 8" impeller. Preferentially, the charge and discharge pumps should be limited to 250 p.s.i. because the casing is tested to 300 psi. For a high-pressure, low volume application, the pumps can be centrifugal pumps having an 8" casing and an 8" impeller.

Figure 4:
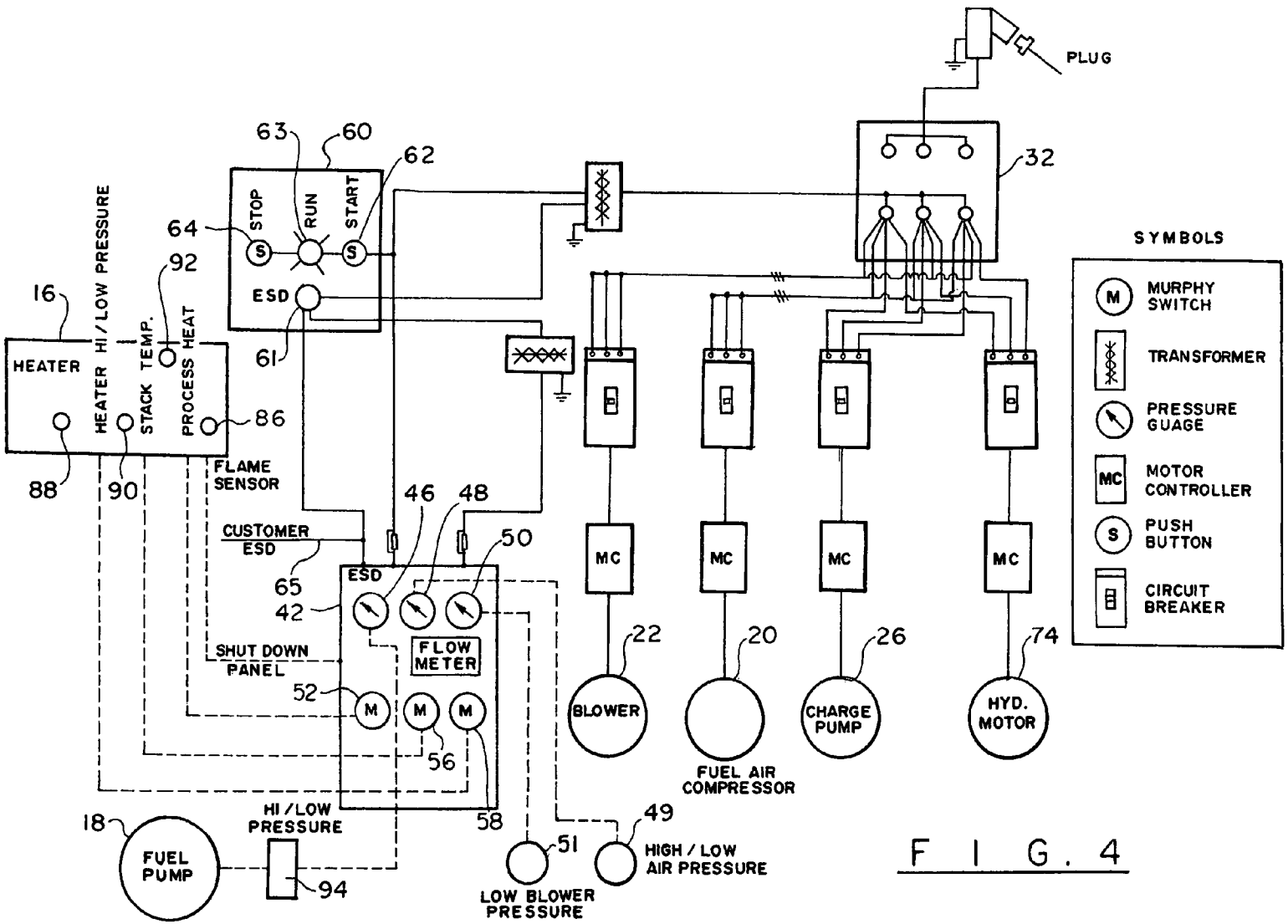
FIG. 4 is a schematic wiring diagram of the cleaning, treating, and/or stimulating system according to the present invention.

A prime mover 32 drives the heater pumps, the air compressor 20, and the blower 22. In a low pressure, high volume application, the prime mover 32 can include several motors, or a single motor. The prime mover could be hydraulic, electric, or diesel, or a combination. Except for the heater 16, which should be a thermal fluid heater, the apparatus of the system could be electric, diesel, hydraulic, or a combination of same which eliminates the need for fan belts, thereby eliminating alignment problems and some maintenance down time. In the embodiment illustrated in FIG. 4, the prime mover 32 is an electric motor.

The heated treating fluid is delivered from the heater 16 to a discharge pump 28, which can be a positive displacement pump, where the heated fluid is pressurized to a degree sufficient to overcome the down-hole pressure existing on the tubing being stimulated. An operator knows the depth of the tubing as well as the diameter of the tubing and can calculate the amount of pressure in the vertical column. Having determined the down-hole pressure, the operator can then determine the amount of heated fluid that needs to be injected in the tubing through the discharge line 29, which is fluidly connected to the wellbore tubing to displace the liquid in the tubing and unclog the perforations in the formation. The flow meter 40 identifies the amount of the treating fluid passing through the heater to the discharge pump 28 and into the wellbore tubing. The flow meter sends the signal of the amount of the treating fluid supplied to the heater 16 per minute to the control panel 42. The positive displacement pump 28 may be a duplex pump, such as for instance a Gardner Denver duplex pump.

A motor 74, which can be hydraulic motor, drives the positive displacement pump 28. Operationally connected to the motor 74 is a hydraulic pump 76, which circulates the hydraulic fluid between a hydraulic tank 78 and the motor 74. A pressure controller 80 feeds into the tank 78 and receives return from the hydraulic pump 76. A flow control 82 regulates the circulation of the hydraulic fluid between the motor 74, the hydraulic pump 76, the return to the hydraulic tank 78, and the pressure controller 80. Using the hydraulic fluid controller 82 and by varying the amount of hydraulic fluid going to the pump 28, an operator can adjust the amount of fluid being discharged from the pump. The pressure controller 80 and the flow controller 82 are parts of the mechanical control system of the unit 10. By varying the amount of pressure going to the discharge pump 28, the operator can control the amount of pressure, against which the pump 28 can push.

The apparatus 10 is provided with a number of safety features that facilitate its operation in the field. Emergency Shut-Down (ESD) 61, is only used when there is some major problem either on the unit or at the unit's location. The ESD 65, on the customer's side, is operated by air pressure. The shut down switches, such as switches 52, 54, and 56 are tied into all operating equipment. If a switch is tripped, the air pressure drops below a set level—the system 10 shuts-down along with all other equipment tied into the customer ESD 65. The air system is tied into the local ESD 61 of the unit 10. The emergency shut down 61 is used in conjunction with and totally separate of the customer ESD 65. The switch 61 is mounted on the operating control panel 60 of the unit and can be activated separately from the customer's ESD 65 in case of a unit malfunction without affecting all other equipment tied into the system.

The apparatus 10 is provided with an electronic flame 86, which is capable of detecting the presence of a flame. The sensor 86 is placed in direct view of the flame for the highest sensitivity. When the sensor does not "see" a flame it locks out the fuel to the heater 16. This is one of the main parts of the shut-down system that all other sensors tie into. If any other sensor is not operating within its normal limits the fuel to the heater 16 will remain locked out.

A heater high/low sensor 88 measures the process fluid pressures entering the heater 16. If the pressure is either too low or high, the unit will lock out the fuel to the heater 16. A stack temperature sensor 90 measures the exhaust gas temperature from the heater 16. If the temperature rises beyond the pre-set limit, this will lock out the fuel to the heater 16. A process heat sensor 92 measures the temperature of the fluid being pumped through the heater. If the temperature rises beyond the pre-set limit, this will lock out the fuel to the heater 16.

A sensor designated as Fuel Pressure High/Low sensor 94 measures the supply fuel pressure going to the heater. If the pressure is either too low or high, the unit will lock out the fuel to the heater 16. An Air Pressure High/Low sensor 49 measures the air pressure going to the heater for the atomization of the fuel. If the pressure is either too low or high, the unit will lock out the fuel to the heater 16. The low blower pressure sensor 51 measures the blower pressure and vacuum in the blower going to the heater. If the pressure is either too low or high, the unit will lock out the fuel to the heater 16.

The reservoir stimulation system of the present invention provides all of the pumping data an operator needs without having to move around the unit from one location to the other for stimulation data. The system 10 is designed as a compact package with safety in mind that meets some of the most stringent regulations in the industry. The operator does not have to go near the discharge hoses to monitor discharge pump pressures, flow volumes, or process temperatures. During operation, an operator has full control of pump flow volumes, product temperature and pressures all in one area. Since the unit is all electric over hydraulic the resulting noise levels is very minimal. The system 10 is a reservoir stimulation package that can be used in many different applications.

In operation, the system according to the invention can produce heated water to clean a mud tank on a vessel or a mud hold of a vessel. Water from overboard can be used as a working fluid, heated up to 212 degrees F., but the temperature is usually restricted to 175 degrees F. or less, and discharged at approximately 142-150 psi at approximately 96 gallons per minute for a 45 minute cleaning cycle. The prime mover motor draws a maximum of approximately 72 amps. At a higher flow rate of approximately 195-200 gallons per minute, the amperage draw rises to 187 amps. An advantage of the system according to one embodiment of the invention over conventional cleaning methods is that less wastewater is generated, better cleaning efficiency is obtained, and less confined space work is needed.

The frame or skid that holds the apparatus of the system according to various embodiments of the invention has a small enough footprint and low enough weight to be effectively portable for vessel and other offshore uses. Economies and efficiencies arise from the particular apparatus used, the combination of apparatus, and the arrangement of the apparatus. The use of valves allows to completely and accurately control the flow and pressure on the positive displacement pump 28.

The discharge flow from the positive displacement pump allows injection of stimulation fluids down hole and counters the pressures in the reservoir as well as the head of fluid in the production pipe. The system 10 allows delivery of a known quantity (gallons in most cases) of the treating fluid, for instance xylene, to the reservoir (strata containing the oil). The volumetric measurement of the inside volume of the drill string from the positive displacement pump 28 to the perforation area is a known factor, and injection of a pre-determined amount of the treating liquid into the formation so as to break up any heavy hydrocarbons and/or paraffin, etc. that have become built up at the crucial flow points, allows the well operator to determine beforehand the amount of treating fluid that will be necessary to accomplish the task.

In one of the embodiments, the apparatus 10 was designed to draw about 150 amperes at 480 volts A/C. This unit has a nine foot by seven foot footprint which makes it very easy to mobilize to different locations. The apparatus 10 was tested by heating diesel (as a treating liquid) and forcing it downhole into the formation through the tubing and perforations to melt and emulsify the sulphur back to a liquid state. The injected fluid allowed lowering of the system pressures to make an easier path for the produced fluid and by relieving restrictions which increased the hydrocarbon production. The air compressor and hydraulic reservoir could be easily monitored via sight glasses of the gauges mounted in the panel 42.

If desired, the electrical power may be used for powering the discharge pump, the fuel pump, the air compressor pump, and the oxygenator/blower as an alternative to the hydraulic power illustrated in the drawings and discussed above.

Many other changes and modifications can be made in the apparatus and method of the present invention without departing from the spirit thereof. We, therefore, pray that our rights to the present invention be limited only by the scope of the appended claims.

We claim:

1. A system for cleaning, treating, and/or stimulating a wellbore reservoir having a pre-determined downhole pressure using a treating fluid, the system comprising:

a surface-mounted assembly comprising a heater device, a charge pump connected to an intake side of the heater device, a fluid flow volume controller configured to regulate a volume of fluid admitted into the heater, a discharge pump connected to an outlet side of the heater device, a means for regulating a discharge flow and a discharge pressure operationally connected to the discharge pump, said heater device being configured for heating the treating fluid to a predetermined temperature; said charge pump being configured for forcing the treating fluid through the heater device; said fluid flow volume controller being mounted between the heater device and the charge pump; said discharge pump being configured to increase the pressure of the treating fluid, said discharge pump being connectable to an inlet side of the reservoir being cleaned, treated and/or stimulated; and wherein the means for regulating the discharge flow and the discharge pressure is configured to regulate the amount of treating fluid delivered under pressure into the wellbore to overcome the pressure existing in a reservoir tubing downhole.

2. The system of claim 1, wherein said means for regulating the amount of treating fluid treating device comprises a flow meter operationally connected to the charge pump.

3. The system of claim 2, further comprising an emergency control means for conducting an emergency shut-down procedure, said emergency control means being operationally connected to the flow meter.

4. The system of claim 3, wherein said emergency control means comprises a plurality of sensors for detecting out-of-range conditions within the heater device.

5. The system of claim 4, wherein said emergency shut-down means further comprises at least one emergency shut-down switch for stopping operation of the system when any one of the plurality of sensors detects an out-of-range condition.

6. The system of claim 4, further comprising a means for delivering compressed air into a fuel nozzle of the heater device for creating an atomized fuel/air mixture in the heater device.

7. The system of claim 6, wherein said means for delivering compressed air comprise an air compressor, an air blower and an air compressor pump operationally connected to a nozzle of the heater device.

8. The system of claim 7, wherein said plurality of sensors comprise a high/low air pressure sensor, a flame sensor, a stack temperature sensor, a low blower pressure sensor, and a heater high/low pressure sensor.

9. The system of claim 8, further comprising a plurality of gauges operationally connected to said sensors and capable of providing visual information of conditions detected by each of said high/low air pressure sensor, flame sensor, stack temperature sensor, low blower pressure sensor, and said heater high/low pressure sensor.

10. The system of claim 7, wherein said air compressor and said air blower are electrically powered.

11. The system of claim 1, wherein said means for regulating the discharge flow and the discharge pressure comprises a discharge flow controller device and a discharge pressure controller device operationally connected to the discharge pump.

12. The system of claim 1, wherein said discharge pump is a hydraulically operated positive displacement pump.

* * * * *